US006718562B1

(12) United States Patent
Saragas

(10) Patent No.: US 6,718,562 B1
(45) Date of Patent: Apr. 13, 2004

(54) FOOT-OPERATED TOILET FLUSHING DEVICE

(76) Inventor: Nikiforos P. Saragas, P O Box 1153, Highlands N 2037, Johannesburg (ZA)

( * ) Notice: Subject to any disclaimer, the term of this patent is extended or adjusted under 35 U.S.C. 154(b) by 0 days.

(21) Appl. No.: 10/302,611

(22) Filed: Nov. 22, 2002

(51) Int. Cl.[7] ..... E03D 5/00
(52) U.S. Cl. ..... 4/249
(58) Field of Search ..... 4/249, 246.1

(56) References Cited

U.S. PATENT DOCUMENTS

| | | | | | |
|---|---|---|---|---|---|
| 937,619 | A | * | 10/1909 | Links et al. | 4/249 |
| 2,043,821 | A | * | 6/1936 | Williams | 4/249 |
| 3,095,582 | A | | 7/1963 | Booth | |
| 4,007,499 | A | * | 2/1977 | Lin | 4/249 |
| 5,056,165 | A | * | 10/1991 | Wescott, Sr. | 4/246.1 |
| 5,068,925 | A | | 12/1991 | Salibi | |
| 5,142,708 | A | | 9/1992 | Johnson et al. | |
| 5,170,513 | A | | 12/1992 | Ambooken et al. | |
| D354,802 | S | | 1/1995 | Bigelow | |

* cited by examiner

*Primary Examiner*—Charles E. Phillips

(57) ABSTRACT

A foot-operated toilet flushing device for flushing a toilet with your foot. The foot-operated toilet flushing device includes an actuator assembly for mounting to a floor. The actuator assembly is positioned adjacent to a front portion of a toilet to facilitate operation of the actuator assembly by a foot of a user. A pivot assembly mounts to the floor. The pivot assembly is positioned adjacent to a rear portion of the toilet to facilitate the operation of a flush lever of the toilet. A linkage assembly operationally couples the actuator assembly, the pivot assembly, and the flush lever together. Actuation of the actuator assembly by the foot of the user moves the linkage assembly through the pivot assembly to operate the flush lever.

11 Claims, 4 Drawing Sheets

FOOT-OPERATED TOILET FLUSHING DEVICE

BACKGROUND OF THE INVENTION

1. Field of the Invention

The present invention relates to toilet flushing devices and more particularly pertains to a new foot-operated toilet flushing device for flushing a toilet with your foot.

2. Description of the Prior Art

The use of toilet flushing devices is known in the prior art. U.S. Pat. No. 5,170,513 describes a toilet flusher for disable people. Another type of toilet flushing device is U.S. Pat. No. 5,068,925 which discloses a foot flush adaptor for commercial latrines.

While these devices fulfill their respective, particular objectives and requirements, the need remains for a device that is more versatile in design.

SUMMARY OF THE INVENTION

The present invention meets the needs presented above by the ncorporation of a linkage assembly that permits the foot actuator ortion to be mounted in a position more accessible to the user, along with a flexible section of the linkage which eliminates the need to hold the foot actuator down until the flush lever on the toilet releases.

An object of the present invention is to provide a new foot-operated toilet flushing device that would eliminate the need for the user to bend over and manually grasp and turn a germ-laden flush lever to flush a toilet.

Another object of the present invention is to provide a new foot-operated toilet flushing device that would be especially useful for those with a physical disability.

Yet another object of the present invention is to provide a flushing device which is particularly user-friendly for small children. Often very young children do not have the ability to reliably flush a toilet either because the handle is out-of reach or because they lack the strength to fully actuate the handle. Further, because many very small children only remember to flush when leaving the bathroom or being prompted by a care-giver, the foot operation of the present invention allows them to keep their hands essentially germ-free.

To this end, the present invention generally comprises an actuator assembly for mounting to a floor. The actuator assembly is positioned adjacent to a front portion of a toilet to facilitate operation of the actuator assembly by a foot of a user. A pivot assembly mounts to the floor. The pivot assembly is positioned adjacent to a rear portion of the toilet to facilitate the operation of a flush lever of the toilet. A linkage assembly operationally couples the actuator assembly, the pivot assembly, and the flush lever together. Actuation of the actuator assembly by the foot of the user moves the linkage assembly through the pivot assembly to operate the flush lever.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
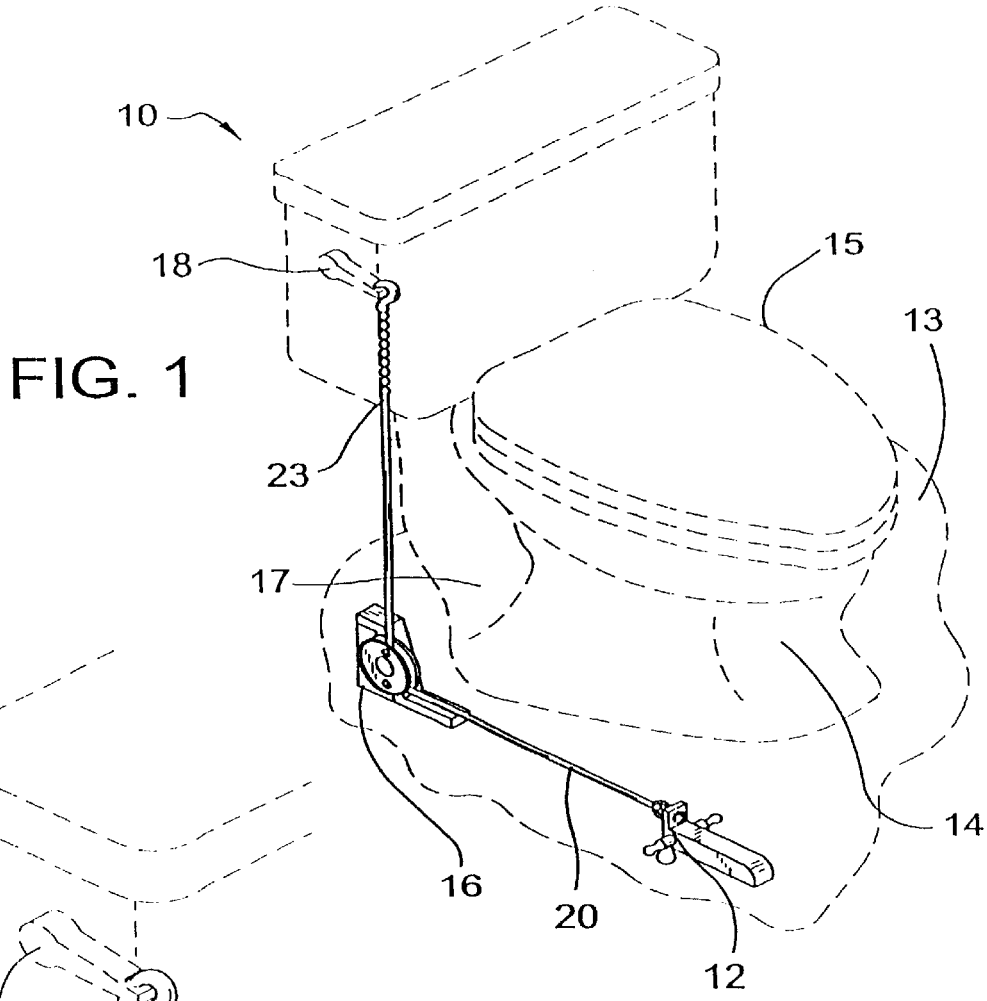
FIG. 1 is a schematic perspective view of a new foot-operated toilet flushing device mounted to the floor and attached to the toilet.
Figure 4:
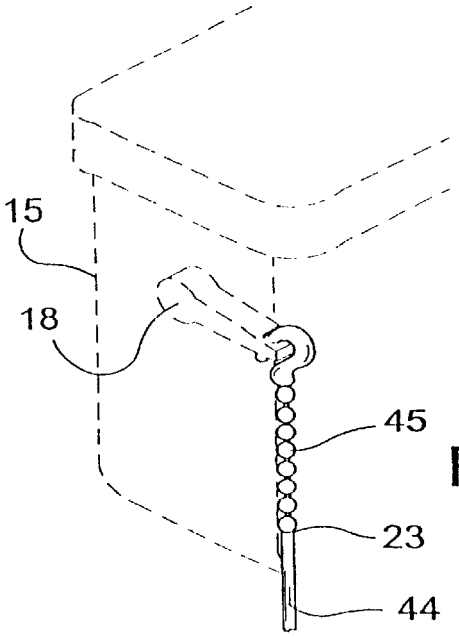
FIG. 4 is a schematic perspective view of the flexible section of the linkage assembly of the present invention.
Figure 2:
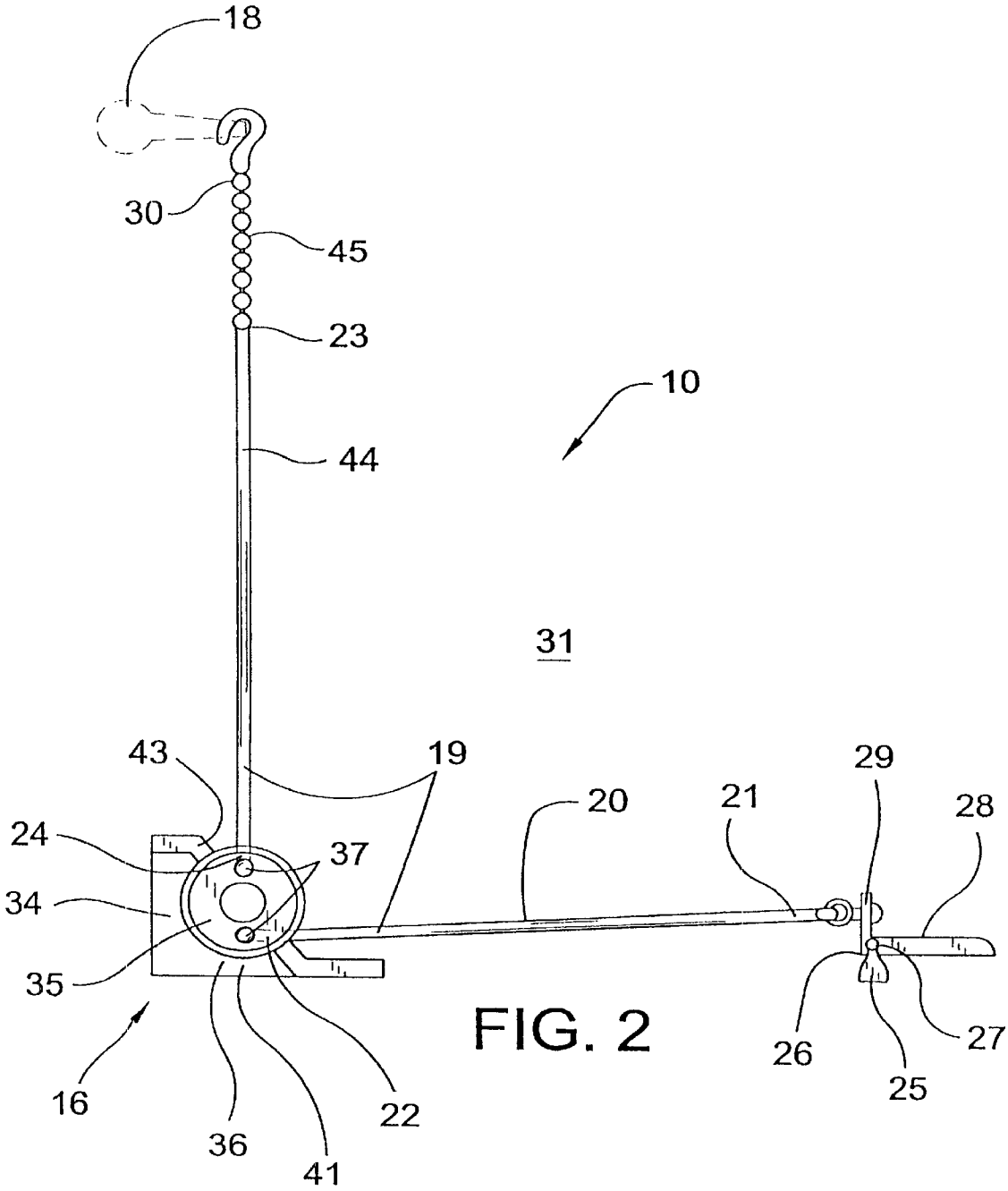
FIG. 2 is a schematic side view of the present invention in the non-actuated position.
Figure 3:
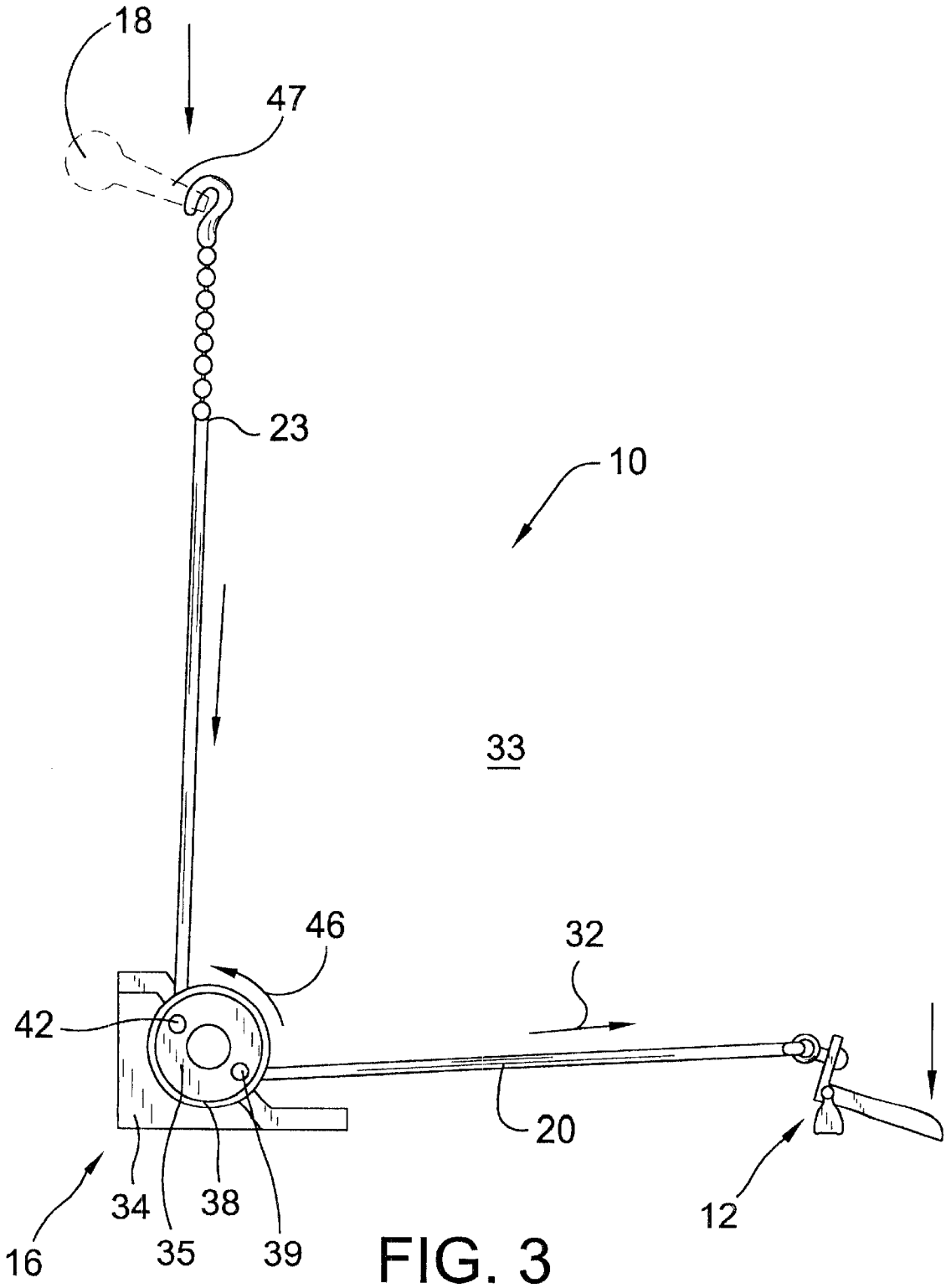
FIG. 3 is a schematic side view of the present invention in the actuated position.
Figure 5:
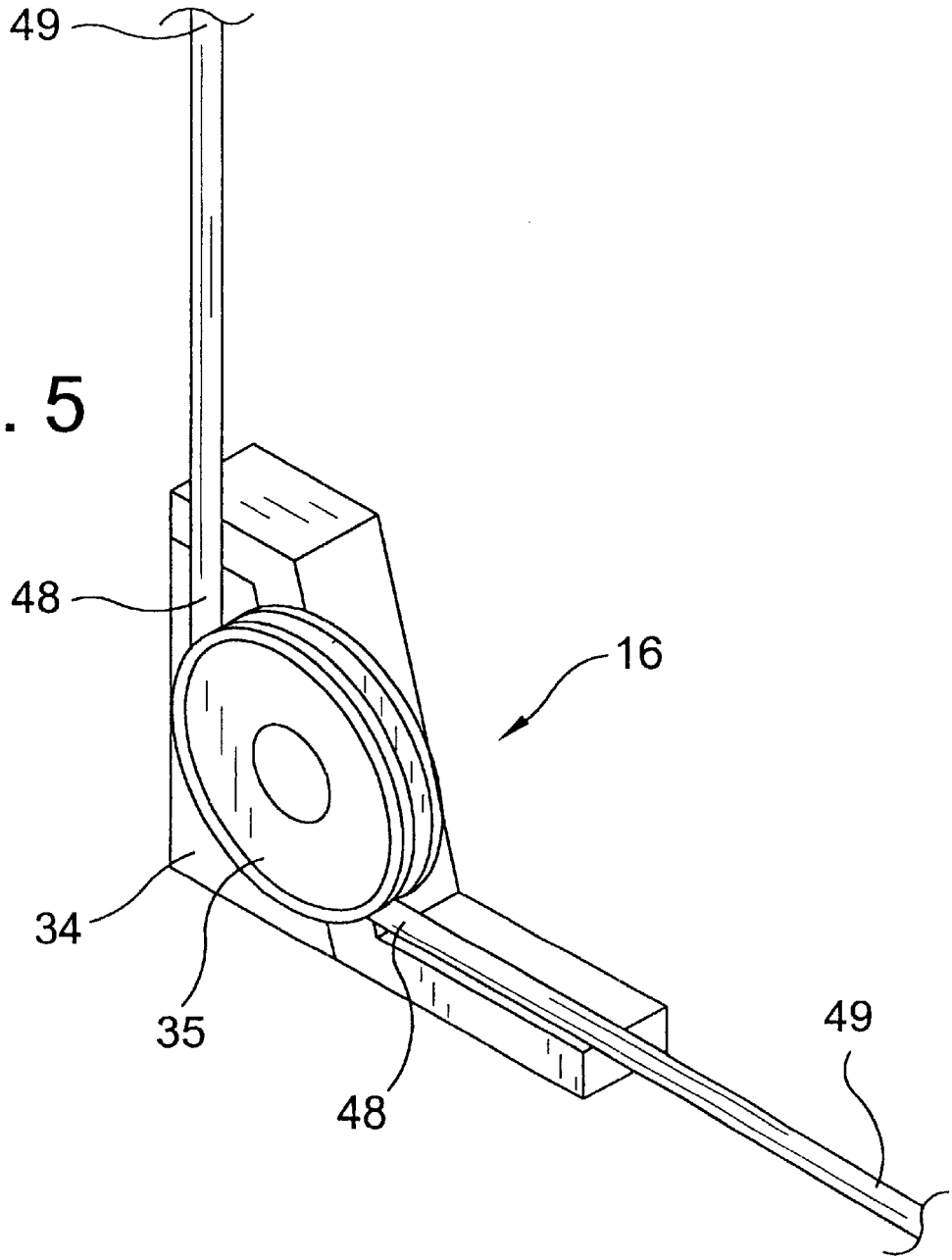
FIG. 5 is a schematic perspective view of an alternate embodiment of the present invention.

With reference now to the drawings, and in particular to FIGS. 1 through 5 thereof, a new foot-operated toilet flushing device embodying the principles and concepts of the present invention and generally designated by the reference numeral 10 will be described.

As best illustrated in FIGS. 1 through 5, the foot-operated toilet flushing device 10 generally comprises an actuator assembly 12 for mounting to a floor 13. The actuator assembly 12 is positioned adjacent to a front portion 14 of a toilet 15 to facilitate operation of the actuator assembly 12 by a foot of a user.

A pivot assembly 16 mounts to the floor 13. The pivot assembly 16 is positioned adjacent to a rear portion 17 of the toilet 15 to facilitate the operation of a flush lever 18 of the toilet 15.

A linkage assembly 19 operationally couples the actuator assembly 12, the pivot assembly 16, and the flush lever 18 together. The linkage assembly 19 includes a first portion 20 and a second portion 23. Each of the portions has a first end 21, 24 and a second end 22, 30. The portions 20, 23 are oriented generally perpendicular to each other and are generally rigid.

The actuator assembly 12 includes an actuator mounting member 25 mounted on the floor 13 adjacent to the front portion 14 of the toilet 15.

The actuator assembly 12 includes a lever member 27 that is rotatably coupled to a top portion 26 of the actuator mounting member 25.

The lever member 26 comprises a foot portion 28 and a linkage portion 29. The portions are oriented substantially perpendicular to each other such that the lever member 26 is L-shaped.

The foot portion 28 of the lever member 26 is oriented generally parallel to the floor 13 and extends generally away from the pivot assembly 16. The linkage portion 29 is oriented generally perpendicular to and extends away from the floor 13 when the actuator assembly 12 is in a non-actuated position 31.

The linkage portion 29 of the lever member 26 is pivotally attached to the first end 21 of the first portion 20 of the linkage assembly 19. The first portion 20 of the linkage assembly 19 is biased in a first direction 32 when the actuator assembly 12 is biased into an actuated position by the foot of the user.

The pivot assembly 16 includes a pivot mounting member 34 mounted on the floor 13 adjacent to the rear portion 17 of the toilet 15 and located generally below the flush lever 18 of the toilet 15.

The pivot assembly 16 includes a pulley member 35 rotatably coupled to a side 36 of the pivoting member 34.

The pulley member 35 has a pair of diametrically opposed coupling members 37 for coupling to the first and second portion 23s of the linkage assembly 19. Each of the coupling members 37 is positioned adjacent to an outer edge 38 of the pulley member 35.

A first of the coupling members 39 is pivotally coupled to a second end 22 of the first portion 20 of the linkage assembly 19 and is positioned proximate to a bottom part 41 of the pivot mounting member 34. A second of the coupling members 42 is positioned proximate to a top part 43 of the pivot mounting member 34. Each of the coupling members 37 is substantially vertically aligned with respect to the floor 13 when in the non-actuated position 31.

The second portion 23 of the linkage assembly 19 comprises a first section 44 and a second section 45. The second section 45 is generally flexible.

The first end 24 of the second portion 23 of the linkage assembly 19 is pivotally attached to the second coupling member 42 of the pulley member 35. The second end 30 of the second portion 23 of the linkage assembly 19 is releasably attachable to the flush lever 18 of the toilet 15.

The pulley moves in a first rotational direction 46 when the first portion 20 of the linkage assembly 19 is biased in the first direction 32 causing the second portion 23 of the linkage assembly 19 to bias an outer end 47 of the flushing lever downward thereby flushing the toilet 15.

The actuator assembly 12 is biased into the non-actuated position 31 by a force exerted on the linkage portion 29 of the lever member 26 by a weight of the first portion 20 of the linkage assembly 19 causing the second section 45 of the second portion 23 of the linkage assembly 19 to flex, thereby allowing the outer end 47 of the flush lever 18 to remain down until a flushing sequence of the toilet 15 is complete.

As an alternate embodiment, the linkage assembly 19 comprises a flexible cable 48 engaging the pulley member 35 of the pivot assembly 16 with opposite ends 49 being attached to the linkage assembly 19 and the flush handle of the toilet 15. Operation of the actuator assembly 12 by the foot of the user causes the cable 48 to pull around the pulley member 35 and downward on the flush lever 18, thereby flushing the toilet 15.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foot-operated toilet flushing device comprising:

an actuator assembly for mounting to a floor, said actuator assembly being positioned adjacent to a front portion of a toilet to facilitate operation of said actuator assembly by a foot of a user;

a pivot assembly for mounting to the floor, said pivot assembly being positioned adjacent to a rear portion of the toilet to facilitate the operation of a flush lever of the toilet;

a linkage assembly for operationally coupling said actuator assembly, said pivot assembly, and the flush lever of the toilet together, said linkage assembly including a first portion and a second portion, each of said portions having a first end and a second end, said portions being oriented generally perpendicular to each other and being generally rigid;

said actuator assembly including an actuator mounting member, said actuator mounting member being mounted on the floor adjacent to the front portion of the toilet;

said actuator assembly including a lever member, said lever member being rotatably coupled to a top portion of said actuator mounting member;

said lever member comprising a foot portion and a linkage portion, said portions being oriented substantially perpendicular to each other such that said lever member is L-shaped; and wherein said actuator assembly is biased into a non-actuated position by a force exerted on said linkage portion of said lever member by a weight of said first portion of said linkage assembly causing said second section of said second portion of said linkage assembly to flex, thereby allowing the outer end of the flush lever to remain down until a flushing sequence of the toilet is complete.

2. The foot-operated toilet flushing device as set forth in claim 1, wherein said foot portion of said lever member is oriented generally parallel to the floor and extends generally away from said pivot assembly, and said linkage portion is oriented generally perpendicular to and extends away from the floot when said actuator assembly is in a non-actuated position.

3. The foot-operated toilet flushing device as set forth in claim 1, further comprising said linkage portion of said lever member being pivotally attached to said first end of said first portion of said linkage assembly, wherein said first portion of said linkage assembly is biased in a first direction when said actuator assembly is biased into an actuated position by the foot of the user.

4. The foot-operated toilet flushing device as set forth in claim 1, further comprising said pivot assembly including a pivot mounting member, said pivot mounting member being mounted on the floor adjacent to the rear portion of the toilet and located generally below the flush lever of the toilet.

5. The foot-operated toilet flushing device as set forth in claim 4, further comprising said pivot assembly including a pulley member being rotatably coupled to a side of said pivot mounting member.

6. The foot-operated toilet flushing device as set forth in claim 5, further comprising said pulley member having a pair of diametrically opposed coupling members for coupling to said first and second portions of said linkage assembly, each of said coupling members being positioned adjacent to an outer edge of said pulley member.

7. The foot-operated toilet flushing device as set forth in claim 6, wherein a first of said coupling members is pivotally coupled to a second end of said first portion of said linkage assembly and is positioned proximate to a bottom part of said pivot mounting member and a second of said coupling members is positioned proximate to a top part of said pivot mounting member, such that each of the said coupling members are substantially vertically aligned with respect to the floor when in said no-actuate position.

8. The foot-operated toilet flushing device as set forth in claim 7, further comprising said first end of said second portion of said linkage assembly being pivotally attached to said second coupling member of said pulley member, said second end of said second portion of said linkage assembly being releasably attachable to the flush lever of the toilet.

9. The foot-operated toilet flushing device as set forth in claim 5, wherein said pulley member moves in a first rotational direction when said first portion of said linkage assembly is biased in said first direction causing said second portion of said linkage assembly to bias an outer end of the flushing lever downward thereby flushing the toilet.

10. A foot-operated toilet flushing device comprising:

an actuator assembly for mounting to a floor, said actuator assembly being positioned adjacent to a front portion of a toilet to facilitate operation of said actuator assembly by a foot of a user;

a pivot assembly for mounting to the floor, said pivot assembly being positioned adjacent to a rear portion of the toilet to facilitate the operation of a flush lever of the toilet;

a linkage assembly for operationally coupling said actuator assembly, said pivot assembly, and the flush lever of the toilet together, said linkage assembly including a first portion and a second portion, each of said portions having a first end and a second end, said portions being oriented generally perpendicular to each other and being generally rigid, said actuator assembly including an actuator mounting member, said actuator mounting member being mounted on the floor adjacent to the front portion of the toilet;

said actuator assembly includinp a lever member, said lever member being rotatably coupled to a ton portion of said actuator mounting member;

said lever member comprising a foot portion and a linkage portion, said portions being oriented substantially perpendicular to each other such that said lever member is L-shaped;

wherein said foot portion of said lever member is oriented generally parallel to the floor and extends generally away from said pivot said pulley member moves in a first rotational direction when said first portion of said linkape assembly is biased in said first direction causing said second portion of said linkage assembly to bias an outer end of the flushing lever downward thereby flushing the toilet; and wherein said actuator assembly is-biased into said non-actuated position by a force exerted on said linkape portion of said lever member by a weight of said first portion of said linkage assembly causing said second section of said second portion of said linkage assembly to flex, thereby allowing the outer end of the flush lever to remain down until a flushing sequence of the toilet is complete. assembly, and said linkage portion is oriented generally perpendicular to and extends away from the floor when said actuator assembly is in a non-actuated position;

said linkage Portion of said lever member being pivotally attached to said first end of said first portion of said linkage assembly, wherein said first portion of said linkage assembly is biased in a first direction when said actuator assembly is biased into an actuated position by the foot of the user;

said pivot assemblv including a pivot mounting member, said pivot mounting member being mounted on the floor adjacent to the rear portion of the toilet and located generally below the flush lever of the toilet;

said Divot assembly including a pulley member being rotatably coupled to a side of said Divot mounting member;

said pulley member having a pair of diametrically opposed coupling members for couplina to said first and second portions of said linkage assembly each of said coupling members being positioned adjacent to an outer cdpe of said pulley member;

wherein a first of said coupling members is pivotally coupled to a second end of said first portion of said linkage assembly and is positioned proximate to a bottom part of said pivot mounting member and a second of said coupling members is positioned proximate to a too part of said pivot mounting member, such that each of said coupling members are substantially vertically aligned with respect to the floor when in said non-actuated position;

said first end of said second portion of said linkage assembly heine pivotally attached to said second coupling member of said pulley member, said second end of said second portion of said linkage assembly being releasably attachable to the flush lever of the toilet;

said pulley member moves in a first rotational direction when said first portion of said linkage assembly is biased in said first direction causing said second portion of said linkage assembly to bias an outer end of the flushing lever downward thereby flushing the toilet; and wherein said actuator assembly is biased into said non-actuated position by a force exerted on said linkage portion of said lever member by a weight of said first portion of said linkage assembly causing said second section of said second portion of said linkage assembly to flex, thereby allowing the outer end of the flush lever to remain down until a flushing sequence of the toilet is complete.

11. A foot-operated toilet flushing device comprising:

an actuator assembly for mounting to a floor, said actuator assembly being positioned adjacent to a front portion of a toilet to facilitate operation of said actuator assembly by a foot of a user;

a pivot assembly for mounting to the floor, said pivot assembly being positioned adjacent to a rear portion of the toilet to facilitate the operation of a flush lever of the toilet;

a linkage assembly for operationally coupling said actuator assembly, said pivot assembly, and the flush lever of the toilet together, said linkage assembly including a first portion and a second portion, each of said portions having a first end and a second end, said portions being oriented generally perpendicular to each other and being generally rigid;

said actuator assembly including an actuator mounting member, said actuator mounting member being mounted on the floor adjacent to the front portion of the toilet;

said actuator assembly including a lever member, said lever member being rotatably coupled to a top portion of said actuator mounting member;

said lever member comprising a foot portion and a linkage portion, said portions being oriented substantially perpendicular to each other such that said lever member is L-shaped;

wherein said foot portion of said lever member is oriented generally parallel to the floor and extends generally away from said pivot assembly, and said linkage portion is oriented generally perpendicular to and extends away from the floor when said actuator assembly is in a non-actuated position;

said linkage portion of said lever member being pivotally attached to said first end of said first portion of said linkage assembly, wherein said first portion of said linkage assembly is biased in a first direction when said actuator assembly is biased into an actuated position by the foot of the user;

said pivot assembly including a pivot mounting member, said pivot mounting member being mounted on the floor adjacent to the rear portion of the toilet and located generally below the flush lever of the toilet;

said pivot assembly including a pulley member being rotatably coupled to a side of said pivot mounting member;

said pulley member having a pair of diametrically opposed coupling members for coupling to said first and second portions of said linkage assembly, each of said coupling members being positioned adjacent to an outer edge of said pulley member;

wherein a first of said coupling members is pivotally coupled to a second end of said first portion of said linkage assembly and is positioned proximate to a bottom part of said pivot mounting member and a second of said coupling members is positioned proximate to a top part of said pivot mounting member, such that each of said coupling members are substantially vertically aligned with respect to the floor when in said non-actuated position;

said second portion of said linkage assembly comprising a first section and a second section, said second section being generally flexible;

said first end of said second portion of said linkage assembly being pivotally attached to said second coupling member of said pulley member, said second end of said second portion of said linkage assembly being releasably attachable to the flush lever of the toilet;

wherein said pulley moves in a first rotational direction when said first portion of said linkage assembly is biased in said first direction causing said second portion of said linkage assembly to bias an outer end of the flushing lever downward thereby flushing the toilet; and wherein said actuator assembly is biased into said non-actuated position by a force exerted on said linkage portion by a weight of said first portion of said linkage assembly causing said second section of said second portion of said linkage assembly to flex, thereby allowing the outer end of the flush lever to remain down until a flushing sequence of the toilet is complete.

* * * * *